United States Patent [19]

Conrey et al.

[11] 4,257,594

[45] Mar. 24, 1981

[54] ELECTRONIC ATHLETIC EQUIPMENT

[75] Inventors: Richard N. Conrey, Ft. Lauderdale, Fla.; Phillip T. McQuaid, Towson, Md.; Paul J. Yursis, Timonium, Md.

[73] Assignees: Richard N. Conrey, Ellicott City; Phillip T. McQuaid, Towson, both of Md.

[21] Appl. No.: 925,141

[22] Filed: Jul. 17, 1978

Related U.S. Application Data

[63] Continuation-in-part of Ser. No. 638,224, Dec. 5, 1975, Pat. No. 4,101,132.

[51] Int. Cl.[3] ..... A63B 61/00

[52] U.S. Cl. ..... 273/29 A; 273/73 D

[58] Field of Search ..... 273/29 A, 26 E, 26 B, 273/73 R, 73 D, DIG. 28, 183 R, 183 D, 186 C, 186 A, 67 R, 97 R, 98, 61 R, DIG. 28, 102.2 R; 35/29 R

[56] References Cited

U.S. PATENT DOCUMENTS

| | | | |
|---|---|---|---|
| 976,176 | 11/1910 | Hollingsworth | 273/186 A |
| 3,122,365 | 2/1964 | August | 273/26 B |
| 3,380,305 | 4/1968 | Charell | 273/26 B |
| 3,436,076 | 4/1969 | Barthol | 273/26 B |
| 3,677,546 | 7/1972 | Oetiker | 273/102.2 R |
| 3,774,194 | 11/1973 | Tokay | 273/31 |
| 3,854,719 | 12/1974 | Supran | 273/61 R |
| 4,071,242 | 1/1978 | Supran | 273/61 R |
| 4,109,911 | 8/1978 | Auken | 273/31 |

FOREIGN PATENT DOCUMENTS

| | | | |
|---|---|---|---|
| 707284 | 5/1941 | Fed. Rep. of Germany | 273/102.2 R |

*Primary Examiner*—Richard C. Pinkham
*Assistant Examiner*—T. Brown
*Attorney, Agent, or Firm*—Pollock, Vande Sande & Priddy

[57] ABSTRACT

A tennis racquet or other athletic instrument configured for striking a moveable ball or other playing element includes electronic sensors for providing an audible or audio-visual indication of the location on the racquet or instrument at which contact is made with the ball or other playing element. Various devices for sensing the location of contact are disclosed.

19 Claims, 20 Drawing Figures

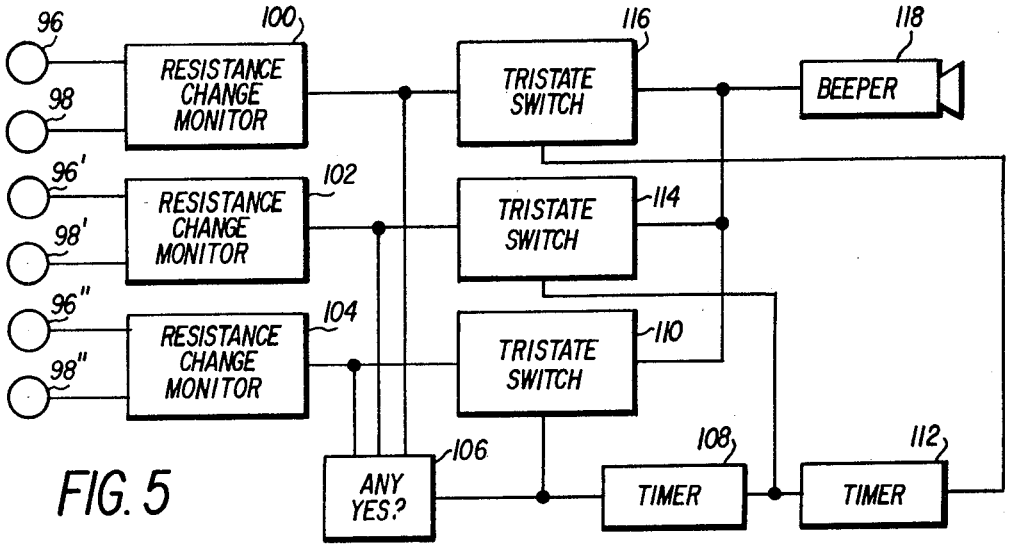
FIG. 5
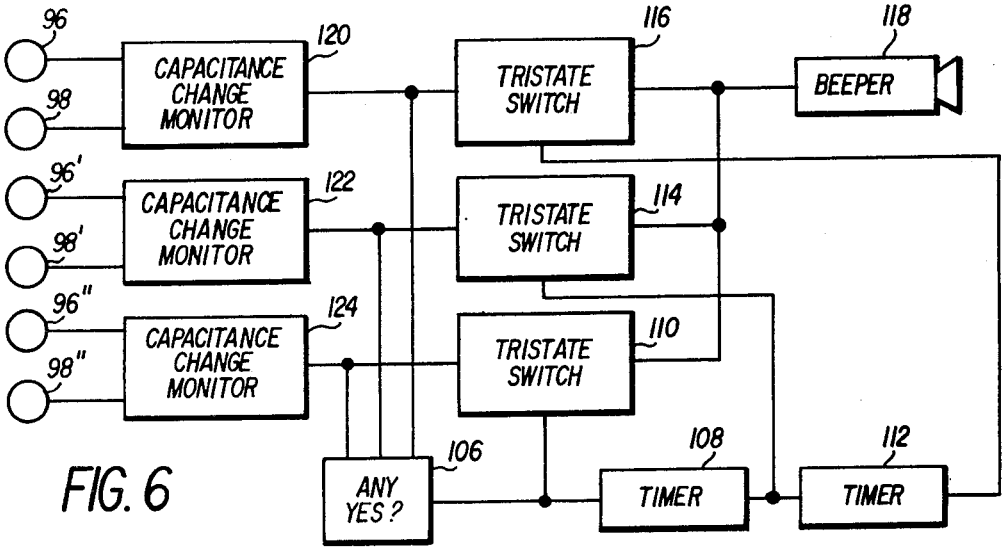
FIG. 6
FIG. 11A
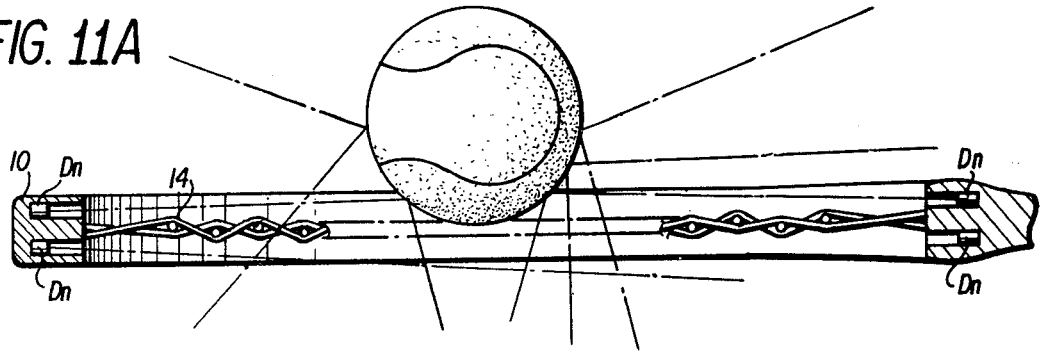

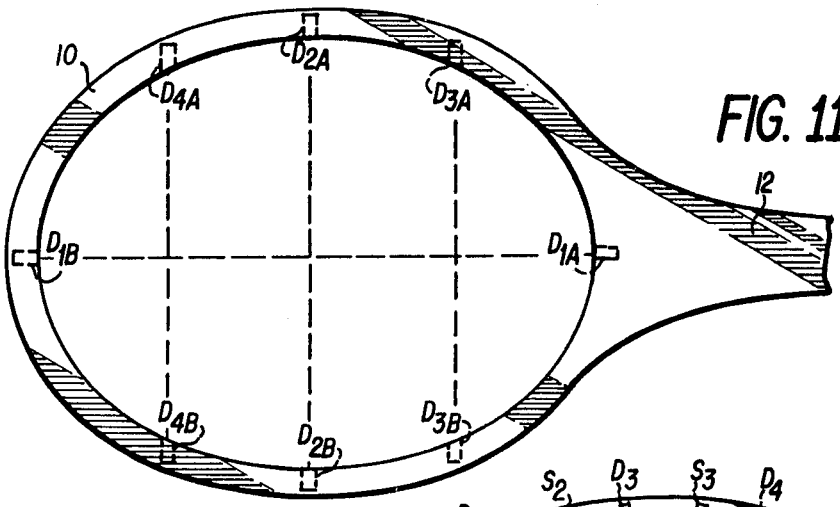
FIG. 11B
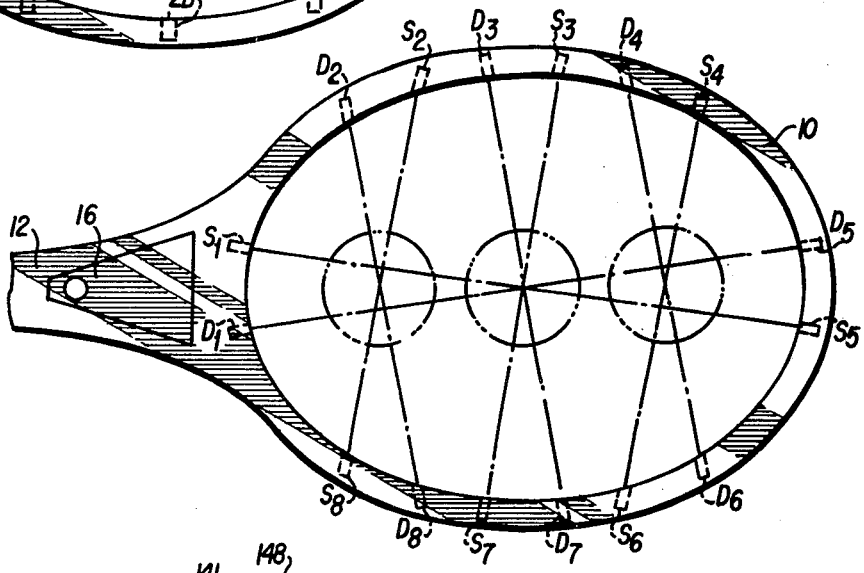
FIG. 14
FIG. 12
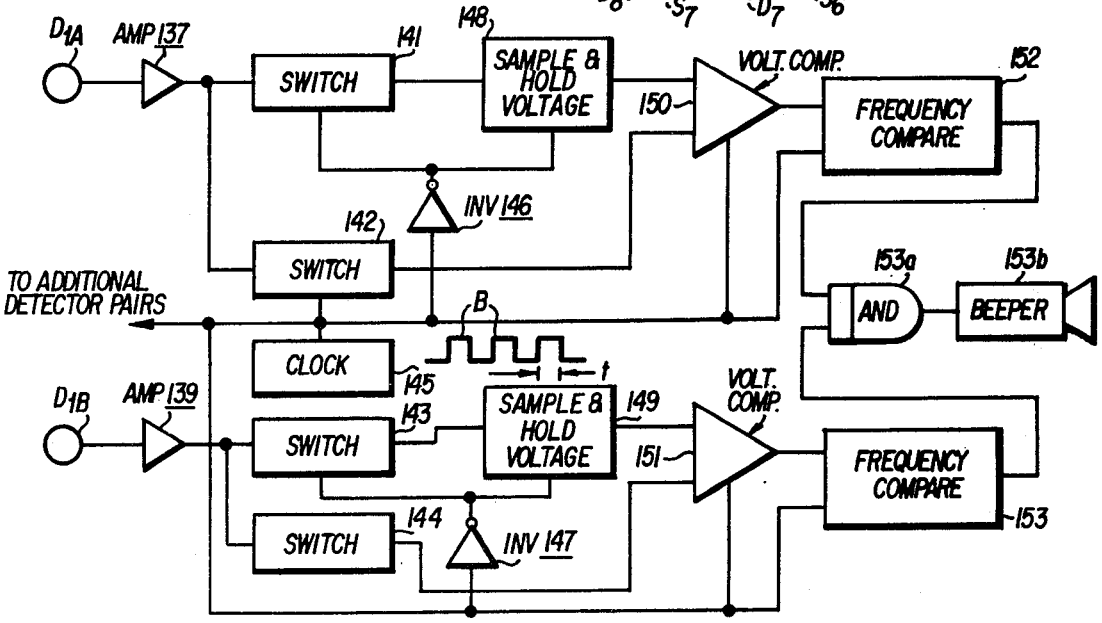

ELECTRONIC ATHLETIC EQUIPMENT

CROSS REFERENCE TO RELATED APPLICATIONS

This application is a continuation-in-part of our copending U.S. patent application Ser. No. 638,224, filed Dec. 5, 1975 (U.S. Pat. No. 4,101,132) and entitled "Electronic Athletic Equipment".

BACKGROUND OF THE INVENTION

In recent years, public interest in competitive sporting activities has increased substantially. Not only are more individuals watching popular spectator sports such as football, baseball and basketball; but also, more and more people are becoming actively involved in regularly playing a large number of competitive sports.

Where more and more individuals are actually playing or attempting to play a particular sport, increased interest is frequently noticed in the problems of how to learn to play; how to improve one's acquired ability to play; and how to avoid any injury to oneself due to play. Considerable basic skills must be acquired by the novice player in most sports, without which proficiency at the game usually suffers and physical injury may result. For example, in the game of tennis a proper grip on the racquet is necessary to enable the player to deliver optimum force to the ball when striking it and to prevent the player from injuring a hand or wrist due to reactive forces generated when the ball is struck.

Also, the location on the strung portion of the racquet at which the ball is struck plays an important role. If the racquet is held with the plane of its strings approximately perpendicular to the path of the racquet as it approaches the ball and if the ball strikes the racquet in approximately the center of the strung area, then the ball will leave the racquet with optimum velocity and the racquet will not twist in the player's hand. However, if the ball strikes the racquet at a location spaced from the center of the strung area, the racquet usually will twist the player's hand about the wrist or snap the hand back toward the elbow, so that the ball leaves the racquet at an undesired angle and less than optimum speed. Another serious effect of such improper hitting of a tennis ball is that the repeated twisting of the arm and snapping of the wrist frequently lead to the injury commonly known as "tennis elbow". Thus, tennis players and coaches have long sought a device or technique for reliably training players to hit the ball consistently in the center or "sweet" part of the strung area, both to improve their game performance and to minimize the likelihood of injury.

In other sports where a ball or other playing or game element is struck by some sort of club, bat, racquet or similar athletic instrument, players also seek to strike the game element with a preferred portion of the instrument at which an optimum "hit" is obtained without undesirable side effects on the player. In addition to tennis, games such as golf, jai lai, ping pong, badminton, baseball, polo, softball, lacrosse, cricket and hockey, all involve the use of an athletic instrument for striking a ball or game element. In each case, the location on the instrument at which contact is made greatly affects the resultant movement of the game element and the reactive force transmitted to the player.

Under these conditions, it is apparent that a need exists for a device or means which will enable a player to know immediately whether the ball or game element has been struck with the proper portion of the athletic instrument. This type of prompt feedback enables the player to correct his swing accordingly. Such a device would facilitate the training of new players and would enable experienced players to improve their game considerably.

OBJECTS OF THE INVENTION

An object of the invention is to provide an improved tennis racquet or other athletic instrument having means for detecting contact or proximity of a ball or game element at preselected locations on the racquet and for indicating the contact or proximity to the player.

Another object of the invention is to provide such a racquet or athletic instrument in which the detecting means are small, durable and light weight and are disposed on the racquet or athletic instrument so as not to interfere with its use during play.

A further object of the invention is to provide for such a racquet or athletic instrument, a remote audio-visual display for indicating the player's performance to others such as coaches or spectators.

These objects of the invention are given only by way of example. Thus, other desirable objects achieved or advantages obtained by the invention may be perceived by those skilled in the art. Nonetheless, the scope of the invention is to be limited only by the appended claims.

SUMMARY OF THE INVENTION

The above and other objects are achieved by the invention, which comprises in one embodiment an athletic instrument such as a racquet, bat, club, stick or the like for striking a moveable game element such as a ball, puck, shuttle cock or the like. The athletic instrument includes an area thereon in which contact with the game element is intended to be made during practice or play. Mounted on the athletic instrument are a number of sensing devices for detecting contact or proximity of the game element at a preselected location or locations within the intended contact area. In a particular mode of the present invention, preselected location or locations are rendered electrically conductive such as by coating or impregnating with an electrically conductive coating. Means are also provided on the athletic instrument for giving the player a positive indication, such as an audible signal, when the game element is struck at one of the preselected locations. In another embodiment, a transmitter is included in the athletic instrument for transmitting data about the player's performance to a remote receiver and display unit, for simultaneous or delayed presentation.

BRIEF DESCRIPTION OF THE DRAWINGS

FIG. 5 shows a block diagram of a resistance change detection and indication circuit for use with the embodiment of FIG. 4.

FIG. 6 shows a block diagram of a capacitance change detection and indication circuit for use with the embodiment of FIG. 4.

FIG. 11A shows a fragmentary section of the strung portion of a tennis racquet embodying the ambient light change sensors used in a further embodiment of the invention.

FIG. 11B shows a plan view of a racquet including this embodiment.

FIG. 12 shows a block diagram of a detection and indication circuit for use with the embodiment of FIGS. 11A and 11B.

FIG. 14 shows a plan view of a tennis racquet embodying the reflected light sensors of the present invention.

DETAILED DESCRIPTION OF PREFERRED EMBODIMENTS

Figure 1:
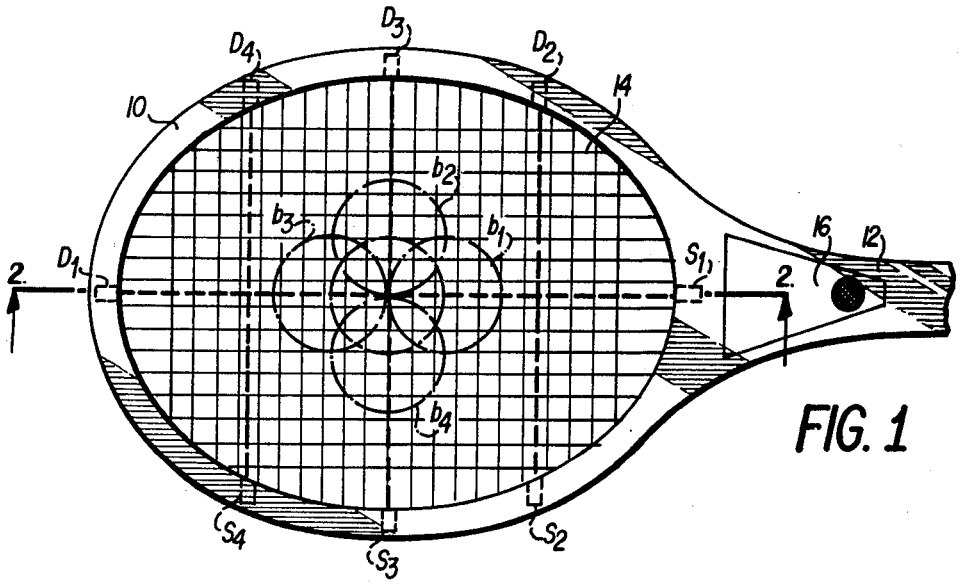
FIG. 1 shows a plan view of a tennis racquet embodying the present invention.

There follows a detailed description of the invention, reference being made to the drawings in which like reference numerals identify like elements of structure in each of the several figures.

FIG. 1 shows a plan view of the strung portion of a tennis racquet embodying the invention. A conventional racquet comprising an oblong, open frame 10 and axially extending handle 12 is used. Frame 10 and handle 12 may be made from laminated wood, metal, graphitic epoxy composites and other materials commonly used, without departing from the scope of the invention. The center of frame 10 is criss-crossed by strings 14 which are threaded through to frame 10 in the conventional manner. As indicated in phantom, a plurality of infra-red light sources, $S_1$, $S_2$, $S_3$, $S_4$ and detectors $D_1$, $D_2$, $D_3$, $D_4$ are located around the periphery of frame 10. The light sources and detectors are aligned so that detector $D_1$ receives primarily ambient light plus the light produced by source $S_1$ and so on, for each detector and source pair $D_2$-$S_2$, $D_3$-$S_3$ and $D_4$-$S_4$. $D_1$ and $S_1$ are arranged so that their light transmission path is approximately on the longitudinal axis of frame 10; whereas, $D_2$-$S_2$, $D_3$-$S_3$ and $D_4$-$S_4$ are arranged so that their light transmission paths are approximately at right angles to the light path of $D_1$-$S_1$. The intersections of the light paths define three preselected zones or areas at which ball contact is to be monitored. The outputs of $D_1$ . . . $D_4$ are connected to a detection and indication circuit 16, which is of micro-circuit construction, housed within handle 12. Although circuit 16 is shown housed at the portion of handle 12 closest to frame 10, it may also be located within the long, hand-grip portion of the racquet if desired.

Considering the center of the strung portion surrounded by frame 10, an area or "sweet spot" is defined at which a player usually intends to make contact with the ball for optimum effect and minimum injury potential, as previously discussed. The light transmission paths from $D_1$-$S_1$ and $D_3$-$S_3$ intersect at approximately the center portion of strings 14 so that both transmission paths will be blocked when the ball enters this area on its way into contact with strings 14. The phantom circles $b_1$, $b_2$, $b_3$ and $b_4$ indicate the range of potential ball positions in which the light transmission paths from both $D_1$-$S_1$ and $D_3$-$S_3$ would be interrupted. When both paths are so interrupted, circuit 16 senses the condition and provides an audible output, as will be discussed with regard to FIG. 3. Thus, the player is continually informed of whether the ball has hit the racquet at the intended location. The intersections of the light transmission paths from $D_2$-$S_2$ and $D_4$-$S_4$ with the path from $D_1$-$S_1$ may also be monitored and signals provided to indicate, when appropriate, whether the player is hitting the ball high or low on the racquet. Of course, any combination of intersecting light transmission paths may be used to monitor other preselected areas within frame 10, without departing from the scope of the invention. Moreover, where the player is interested only in monitoring hits on a single axis of the racquet, a single source detector pair may be used. For example, source $S_1$ and detector $D_1$ can be used to monitor hits on the long axis of the racquet. While infra-red light sources and detectors are preferred in the opto-electrical embodiments of the invention, other types of electro-magnetic wave generators and detectors such as radio wave generators and receivers, may be used within the scope of the invention.

Figure 2A:
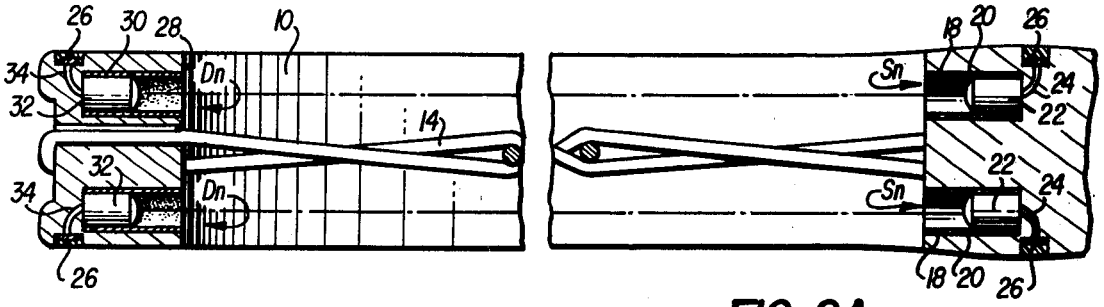
FIGS. 2A and 2B show sections taken along line 2—2 of FIG. 1, indicating alternate modes of attaching the optoelectrical sensors used in the invention.
Figure 2B:
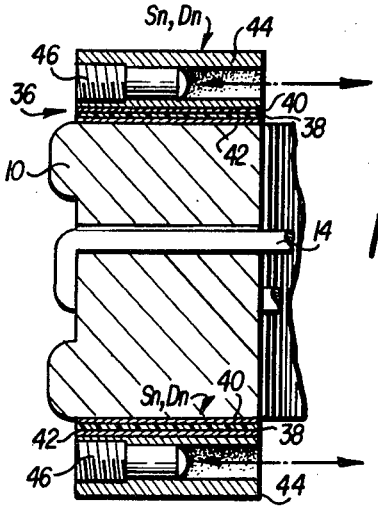

FIGS. 2A and 2B show elevational, section views of frame 10, indicating alternate modes of installing the detectors and sources shown in phantom in FIG. 1. In FIG. 2A, sources $S_n$ and detectors $D_n$ are installed on both sides of strings 14 to ensure proper system response to a ball approaching the racquet from either side. Each source $S_n$ comprises a metal tube 18 snugly seated within a bore 20 which runs parallel to the plane of strings 14. Mounted within tube 18 is an infra-red light-emitting diode 22, such as an RCA SG1004, having a diameter approximately equal to (a) the inside diameter of tube 18 and (b) to one fourth of the length of tube 18. Thus, diode 22 is recessed within tube 18, which produces a beam of narrow divergence projecting toward detector $D_n$. The interior surface of tube 18 is polished to act as a light reflector. Electrical leads 24 from each diode 22 are led away in a groove 26 in the outer surface of frame 10. To protect leads 24, roove 26 may be filled with a high impact epoxy.

Arranged across from sources $S_n$ are detectors $D_n$ which are similarly fashioned. Each detector $D_n$ comprises a metal tube 28 snugly seated within a bore 30 which is parallel to the plane of strings 14. The source and detector of each pair preferably are aligned so that light from each source will strike only one detector; however, the use of wide-divergence single sources for two or more detectors or reflecting mirrors or prisms to redirect the light to a plurality of sources is also within the scope of this invention. Mounted within tube 28 is an infra-red sensitive photo-transistor 32, such as a Monsanto MT2, having a diameter approximately equal to (a) the inside diameter of tube 28 and (b) to one fourth the length of tube 28. Thus, transistor 32 is recessed within tube 28, which renders it less sensitive to light entering tube 28 along any transmission path other than that leading from source $S_n$. The interior surface of tube 28 is blackened to minimize further effects of ambient light entering the tube. Electrical leads 34 from each transistor 32 also are led away in groove 26 in the outer surface of frame 10.

When a tennis ball approaches a location where the light transmission paths cross from two or more source-detector pairs, the light beams travelling such paths will be broken simultaneously, even before the ball actually contacts string 14. Thus, the opto-electrical sensors actually detect the presence or proximity of the ball relative to the racquet, before ball contact.

FIG. 2B shows an alternative way of mounting source-detector pairs $S_n$-$D_n$ on a conventional tennis racquet. For ease in illustrating the details of the embodiment, only one side of frame 10 is shown in section. This embodiment is advantageous in that a conventional tennis racquet may be modified in accordance with the invention, without the need to provide mounting bores and conductor grooves as with the embodiment of FIG. 2B. The upper and lower surfaces of frame 10 are covered with a thin tape 36, such as that manufactured by Circuit-Stick, Inc., Gardena, Calif. (No. 7102). Tape 36 comprises a central layer 38 of G-10 epoxy plastic having thin copper layers 40 and 42 on either side thereof. Conductor paths (not shown) are etched into copper layers 40 and 42, whereby tape 36 may be used as a sort of buss-board for connecting source-detector pairs $S_1$-$D_1$. . . $S_n$-$D_n$ to detection and indication circuit 16. Secured to tape 36 by means such as epoxy cement are a plurality of source-detector tubes 44, which are preferably of aluminum. One side of each tube is flattened, as indicated, for ease of attachment to tape 36. Tubes 44 are sized as are tubes 18, relative to the size of their source or detector, to minimize light divergence and ambient light effects. Sources $S_n$ or detectors $D_n$ are mounted within tubes 44 at their outside ends. Threaded plugs 46 close tubes 44 to retain the sources and detectors. Conductors (not shown) are led from each source to the appropriate conductor paths on tape 36, to provide proper connection to circuit 16. As in the embodiment of FIG. 2A, the interior surface of tubes 44 is shiny for sources $S_1$ . . . $S_n$ and blackened for detectors $D_1$ . . . $D_n$. Because the source-detector pairs are located higher above the strings 14 than in the embodiment of FIG. 1, the light beams hit a larger portion of the ball and the zones monitored are correspondingly larger.

While it is preferred, for better reliability, to mount source detectors on both sides of the strings 14, experience has shown that pairs mounted on one side only will detect hits on both sides, provided the source-detector pairs are mounted close enough to the strings. In this case, the strings will deflect from the side where impact occurs sufficiently to break the transmission paths on the other side of the strings. How close the source-detectors are placed to the strings will depend on the string flexibility and tension, as will be appreciated by those in the art.

Figure 3:
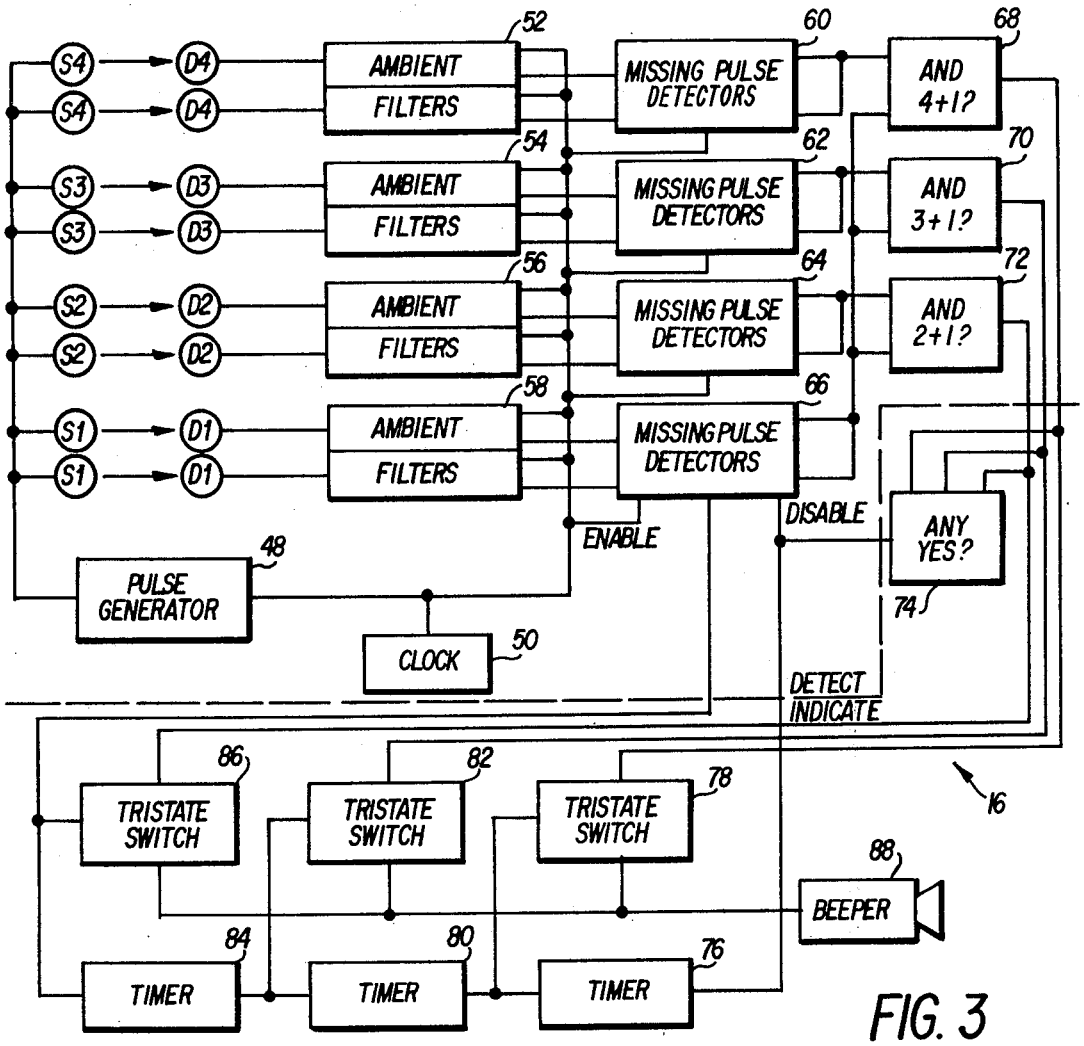
FIG. 3 shows a block diagram of a detection and indication circuit for use with the embodiment of FIGS. 2A and 2B.

FIG. 3 shows a block diagram of detection and indication circuit 16. Four pairs of sources and detectors are shown as in FIG. 1, with a source or detector mounted on each side of strings 14 as in FIGS. 2A and 2B. Those skilled in the art will recognize, however, that a smaller or larger number of source-detector pairs could be added without departing from the scope of the invention. However, it is preferred that at least two intersecting light paths remain to define at least one preselected area on the strung portion of the racquet. Each source $S_1$ to $S_4$ is powered by a pulse generator 48, driven by a clock 50. The pulsed outputs of the sources are received by detectors $D_1$ to $D_4$, which deliver their outputs to ambient filters 52, 54, 56 and 58. Ambient filters are required to filter out the effects of variations in the ambient light so that circuit 16 will respond properly to interruptions in the light pulses passing between the sources and the detectors. Filters 52, 54, 56 and 58 are also activated by clock 50 in the familiar manner, so that they will be operational only when there is a light pulse to be received and detected by the detectors. From the ambient filters, the detector pulses are fed to missing pulse detectors 60, 62, 64 and 66 which are also activated by clock 50. When a missing pulse detector is receiving a pulse signal for each pulse from clock 50, its output will be a logic "no". When a pulse is missed due to interruption of the transmission path by the tennis ball or other game element, the missing pulse detector output will be a logic "yes".

As shown in FIG. 1, the light transmission path of source-detector pair $S_1$-$D_1$, will always be broken if the ball strikes at its intersection with the paths from pairs $S_2$-$D_2$, $S_3$-$D_3$ or $S_4$-$D_4$. Thus, a "yes" output from detector 66 and any one of detectors 60, 62 and 64 will indicate ball contact at one of the preselected areas on strings 14. To detect such an occurrence, the output of detector 66 is supplied as one input to AND gates 68, 70 and 72. The other inputs to AND gates 68, 70 and 72 are supplied, respectively, by missing pulse detectors 60, 62 and 64. When both inputs to one of AND gates 68, 70 and 72 are a logic "yes", the output will be a logic "yes". The outputs of gates 68, 70 and 72 are supplied to an OR gate 74 which puts out a signal when any "yes" signal is received from gates 68, 70 and 72.

A signal from OR gate 74 commences the indication function of the invention. Missing pulse detector 66 is disabled by the signal so that no further "yes" signals will come from AND gates 68, 70 and 72 until the indication function has been completed. The output from OR gate 74 also starts a timer 76 which puts out a signal as soon as missing pulse detector 66 has been disabled. The signals from AND gate 68 and timer 76 are supplied to a tri-state switch 78, or similar device, which puts out a logic "no" if the signal from AND gate 68 is a "no" and a "yes" if the signal from AND gate 68 is a "yes". The signal from timer 76 also starts a timer 80 which puts out a signal as soon as switch 78 has produced its output. The signals from AND gate 70 and timer 80 are supplied to a tri-state switch 82 which functions identically to switch 78, to produce a "yes" or "no" output. The signal from timer 80 also starts a timer 84 which puts out a signal as soon as switch 82 has produced its output. The signals from AND gate 72 and timer 84 are supplied to a tri-state switch 86 which functions identically to switches 78 and 82 to produce a "yes" or "no" output. The signal from timer 84 also resets missing pulse detector 66 to prepare the device to detect the next contact.

The circuit thus produces a series of output signals such as "yes-no-no", "no-yes-no" and "no-no-yes" which are supplied to an indicating device such as a beeper 88. Beeper 88 is chosen to produce a different output tone for "yes" and "no" signals, thus the player can tell easily by the tone sequence whether the ball was hit at the central "sweet spot" or high or low on the strings. Of course, if the ball does not hit one of the preselected areas, no output signal will be generated at all. Those skilled in the art will appreciate that by the addition of more source-detector pairs and circuitry, a racquet embodying the invention may be configured to signal ball contact at an infinite number of preselected locations, as may be necessary for a particular player or coach.

Figure 4:
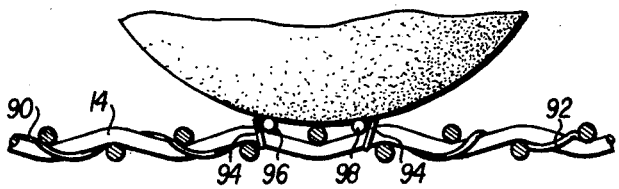
FIG. 4 shows a fragmentary view of the strung portion of a tennis racquet embodying the resistance or capacitance change sensors used in one embodiment of the invention.

FIG. 4 shows a fragmentary sectional view of the strung area of a tennis racquet embodying another detector according to the invention. In this instance, a pair of fine wire leads 90 and 92 are wound about strings 14, with the lead ends spaced a distance approximately equal to the string spacing on the racquet. Threads 94 may be used to secure wires 90 and 92, or other attachment means compatible with strings 14, such as epoxy cement. The lead ends of wires 90 and 92 terminate in small contact elements such as spherical elements 96 and 98 which may be applied by welding or soldering. When a ball strikes strings 14 in the vicinity of wires 90 and 92 so that the ball bridges the gap between contacts 96 and 98, the electrical characteristics of the circuit thus formed are altered, thereby providing an indication of ball contact.

FIG. 5 shows a block diagram of a circuit adapted to measure a change in resistance or resistivity between contacts 96 and 98. For an application when three preselected areas are to be monitored during play, resistance change detectors 100, 102 and 104 are provided, which produce a logic "no" when the resistance between contacts 96 and 98 is above a preselected limit, and a logic "yes" when the resistance drops to a predetermined level indicative of a ball bridging elements 96 and 98. Resistance measuring circuits of the type suitable for this purpose are shown in chapter 6 of *Guidebook of Electronic Circuits* by John Markus, McGraw-Hill Book Company (New York, 1974). A conventional tennis ball may be used for this embodiment; however, the sensitivity is improved if the ball is coated lightly with a conductive paint or provided with a conductive surface as shown in U.S. Pat. No. 3,854,719. The outputs of detectors 100, 102 and 104 are supplied to an OR gate 106. When gate 106 receives a "yes" input, it produces an output to a timer 108 and to tri-state switch 110, which is identical to switches 78, 82 and 86. Timer 108 puts out a signal as soon as switch 110 has produced its "yes" or "no" output. The signal from timer 108 starts timer 112 and actuates tri-state switch 114. When switch 114 has produced its output, timer 112 actuates tri-state switch 116. As in the circuit of FIG. 2, the "yes-no-no", "no-yes-no" or "no-no-yes" outputs of switches 110, 114 and 116 are supplied in series to beeper 118 to produce a tone sequence indicative of the area of ball contact. As before, failure to bridge one of the contact pairs results in no tone signal at all. Also, as before, the circuit resets itself for the next ball.

Figure 18:
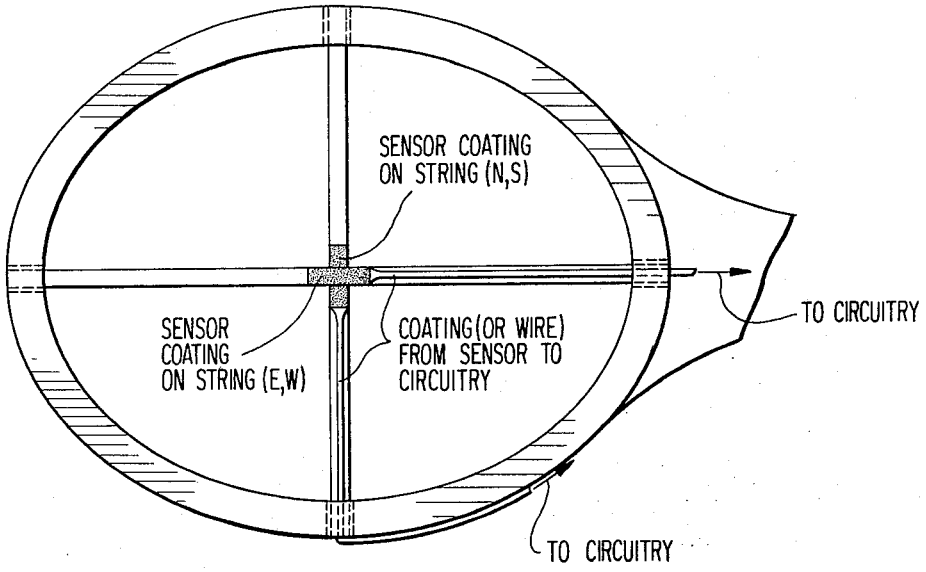
FIG. 18 shows a plan view of a tennis racquet showing the electrically conductive embodiment of the present invention.

The circuit illustrated in FIG. 5 adapted to measure a change in resistance is also suitable for the embodiment of the type illustrated in FIG. 18. In the type of embodiment illustrated in FIG. 18, the strung area is impregnated and/or coated with an electrically conductive coating composition at preselected location or locations for detecting contact or proximity of the game element at a preselected location or locations within the intended contact area. Although FIG. 18 illustrates impregnating or coating the strung area in the "sweet spot", it is understood that any locations can be impregnated or coated such as all of the strung area except for the "sweet spot". As shown, at least one string in the north-south direction and one in the east-west direction are connected electrically to different terminals of the circuit. This can be achieved by extending the electrically conductive coating of at least one string in each axis all the way to the frame, and then either coating the frame from the strings or leading an electrical conducting wire from the strings to the respective terminals of the circuit.

Any coating can be employed as long as it is sufficiently electrically conductive for detecting a change in electrical properties and will impregnate and/or coat the strings. Electrically conductive coatings are well known and need not be described herein in any great detail. An example of a suitable conductive coating especially for nylon strings is available from E. I. Du Pont de Nemours under the trade designation "Hypalon-20" (a chlorosulfonated polyethylene) containing Vulcan XE (an oil furnace carbon black). The thickness of the coating employed can vary greatly and need only be thick enough that sufficient current flows therethrough so that a change in electrical properties is detectable with the circuitry employed. Thicknesses of about 1 mil to about 1/10" are suitable. When a ball strikes at least two strings in the coated or impregnated area, the electrical characteristics such as the resistance to the current flowing through the coating is changed due to the impact of the ball and/or the ball bridging a pair of contacts. This change is then detected by the circuit shown in FIG. 5 and an appropriate signal is generated.

A conventional tennis ball may be used for this embodiment; however, the sensitivity is improved if the ball is coated lightly with a conductive paint or provided with a conductive surface as shown in U.S. Pat. Nos. 3,854,719 and 4,071,242.

FIG. 6 shows another form of detection and indication circuit which may be used with the contact arrangement shown in FIG. 4. Instead of detecting a change in the resistance between contacts 96 and 98, a change in capacitance is monitored by capacitance change detectors 120, 122, and 124. Such devices are shown in Chapter 13 of *Guidebook of Electronic Circuits* by John Markus, McGraw-Hill Book Company (New York, 1974). The outputs of these detectors are processed in a manner identical to that discussed with regard to FIG. 5.

Figure 7:
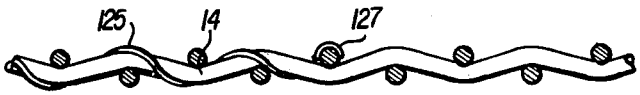
FIG. 7 shows a fragmentary view of the strung portion of a tennis racquet embodying the capacitive phase angle change sensors used in still another embodiment of the invention.

FIG. 7 shows a fragmentary sectional view of a tennis racquet embodying the capacitive phase angle detector of the invention. This type of detector comprises a single wire lead 125 which is wound around strings 14, with a small, metallic plate 127 about ¼ inch by ¼ inch soldered or welded to the end of lead 120. Plate 127 is located on strings at a place where a ball contact is to be monitored. When an A-C voltage is impressed on lead 125, plate 127 generates a certain field in the surrounding air. When the dielectric characteristics of the surrounding air change substantially, such as when a ball contacts plate 127, the capacitive phase angle of the circuit changes. This change is monitored to provide an indication of when ball contact has occurred.

Figure 8:
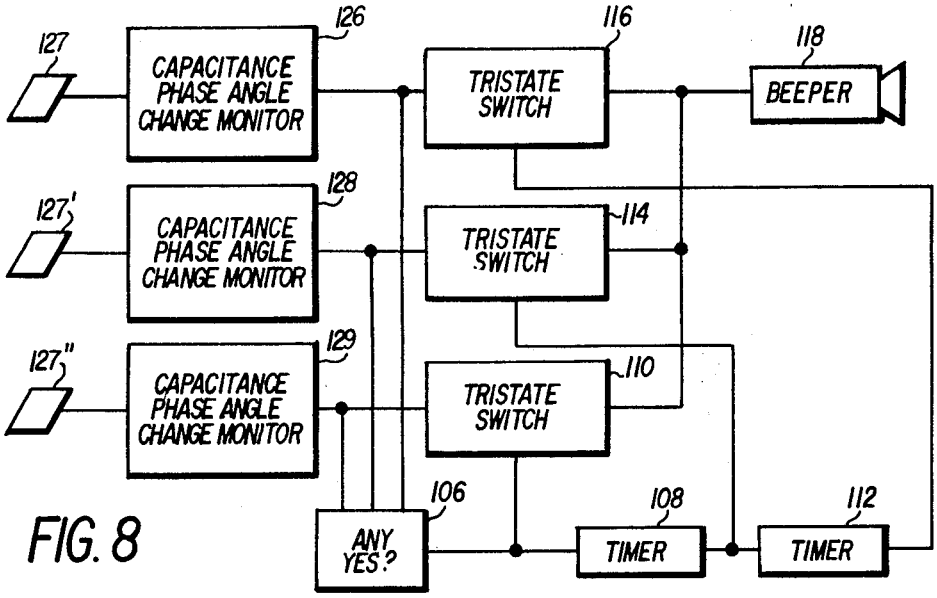
FIG. 8 shows a block diagram of a detection and indication circuit for use with the embodiment of FIG. 7.

FIG. 8 shows a block diagram of a circuit which may be used with the capacitive plate 122 shown in FIG. 7. For an application where three preselected areas are to be monitored during play, capacitive phase angle change detectors 126, 128, and 129 are provided which produce a logic "no" when the capacitive phase angle of plate 127 is within preselected limits, and a logic "yes" when the phase angle changes by a predetermined amount. Such devices also are shown in Chapter 13 of *Guidebook of Electronic Circuits* by John Markus, McGraw-Hill Book Company (New York, 1974). The outputs of detectors 126, 128, and 129 are processed in a manner identical to that discussed with regard to FIGS. 5 and 6. Reset occurs as previously discussed.

Figure 9:
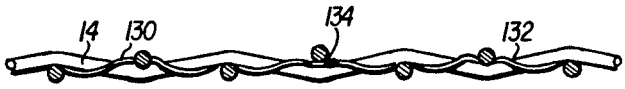
FIG. 9 shows a fragmentary view of the strung portion of a tennis racquet embodying the piezo element sensors used in yet another embodiment of the invention.

FIG. 9 shows a fragmentary sectional view of a tennis racquet embodying the piezo element detector of the invention. This type of detector comprises a pair of wire leads 130 and 132 wound around strings 14 and connected to a piezo element 134. Element 134 preferably is located between strings 14 at an intersection thereof, and may be either a piezo electric or piezo resistive element. When a ball strikes strings 14 in close proximity to the location of element 134, the stress induced in the element produces a voltage or resistance change, depending on the type of element 134 in use. This change is monitored to indicate ball contact in the area.

Figure 10:
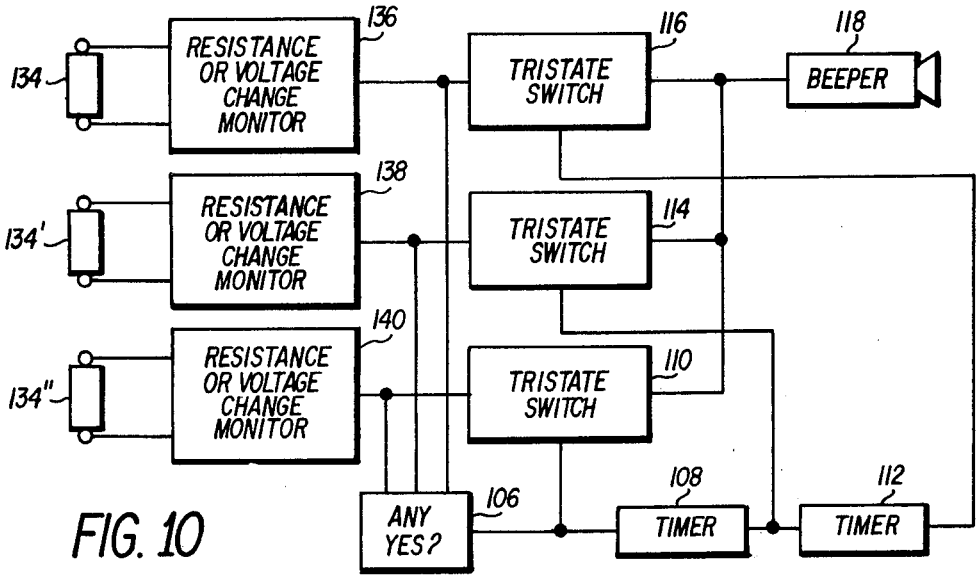
FIG. 10 shows a block diagram of a detection and indication circuit for use with the embodiment of FIG. 9.

FIG. 10 shows a block diagram of a circuit which may be used with the piezo element detector shown in FIG. 9. For an application where these preselected areas are to be monitored during play, resistance or voltage change detectors 136, 138 and 140 are used. Those skilled in the art will realize that different circuits are used to monitor resistance and voltage changes; however, for simplicity in the drawing both types of circuits are represented by elements 136, 138 and 140. Chapters 49 and 64 of the Markus guidebook mentioned previously herein show typical resistance and voltage measuring circuits suitable for use in this embodiment. Detectors 136, 138 and 140 produce a logic "no" when the characteristics of element 134 are within preselected limits, and a logic "yes" when the characteristics change by a predetermined amount. The outputs of detectors 136, 138 and 140 are processed in a manner identical to that discussed with regard to FIGS. 5, 6 and 8.

FIG. 11A shows another opto-electrical embodiment of the invention in which only light detectors are used, which are activated by changes in the ambient light reaching them. As in the embodiment shown in FIG. 2A, detectors $D_n$ are shown mounted in bores in frame 10; however, the mounting arrangement of FIG. 2B may also be used. Because detectors $D_n$ are recessed deep within their bores, the light reaching them must come in essentially along the axis of the bores. Thus, a ball moving across the axis of the bore of a detector Dn will either deflect some of the light rays passing toward the detector into other directions away from the detector, or deflect some of the light rays not passing toward the detector into a direction toward it. When this happens, the intensity of the light reaching the detector may rise or fall. The change in intensity is therefore a function of the presence of the ball on or near the axis of the detector bore. By placing two or more detectors opposite each other so that their bore axes, as extended, are colinear, or nearly so, the presence of a ball or game element approximately midway between the detectors will cause a change in the light intensity reaching both detectors. Each detector thus serves as a check on the one opposite it, to prevent false triggering by sudden changes in ambient light intensity reaching only one detector.

To monitor more than one location on a racquet, a plurality of such detector pairs may be provided, as shown in FIG. 11B. Here, detectors $D_{1A}$ and $D_{1B}$ provide a double-check for detectors $D_{2A}$ and $D_{2B}$, at the "sweet spot" of the racquet. Detectors $D_{3A}$-$D_{3B}$ and $D_{4A}$-$D_{4B}$ monitor the central, end portions of the strung area, so that three zones are monitored, as in the embodiment of FIG. 1. The use of orthogonal detectors such as $D_{1A}$-$D_{1B}$ and $D_{2A}$-$D_{2B}$ is preferred for maximum reliability; however, single detector pairs are also considered acceptable.

FIG. 12 shows a block diagram of a circuit suitable for use with the embodiment of FIGS. 11A and 11B. The outputs of detectors $D_{1A}$ and $D_{1B}$ are supplied to preamplifiers 137 and 139 which are connected, respectively, to parallel switches 141 and 142, and 143 and 144. Clock 145 provides an output of pulses B as indicated schematically in the Figure. Pulse duration "t" is chosen so that the slowest moving ball expected will have time to hit the racquet strings and rebound before clock 145 changes state again. The output of clock 145 is fed directly to switches 142 and 144; and, via inverters 146 and 147, to switches 141 and 143. Thus switches 141 and 143 are closed when switches 142 and 144 are open. While switches 141 and 143 are closed, the outputs from the detectors are supplied to voltage sample and hold circuits 148 and 149 which have been activated via inverters 146 and 147. When switches 141 and 143 are closed, their outputs and the outputs of sample and hold circuits 148 and 149 are supplied to voltage comparators 150 and 151 which have been activated by clock 145. If something has caused a fast change of predetermined magnitude in the intensity of the light reaching the detectors, comparators 150 and 151 will produce outputs which are supplied, respectively, to frequency comparators 152 and 153. Frequency comparators 152 and 153 are required to prevent false triggering by something other than a tennis ball, which causes a long duration change in the signals coming from detectors $D_{1A}$ and $D_{1B}$. A tennis ball causes a very quick change followed by a quick return to normal. If only voltage and not frequency were checked, the device would respond to long duration changes such as would occur if the player placed a hand on the strings momentarily. The "yes" outputs from comparators 152 and 153 are then supplied to AND gate 153*a* which conducts to beeper 153*b* only when two "yes" signals are received. Those skilled in the art will realize that additional coincidence circuitry could be added so that no output would be achieved unless both the $D_1$ and $D_2$ detector pairs respond simultaneously, referring to the embodiment of FIG. 11B. As in the previous embodiments, reset is automatic.

Figure 13:
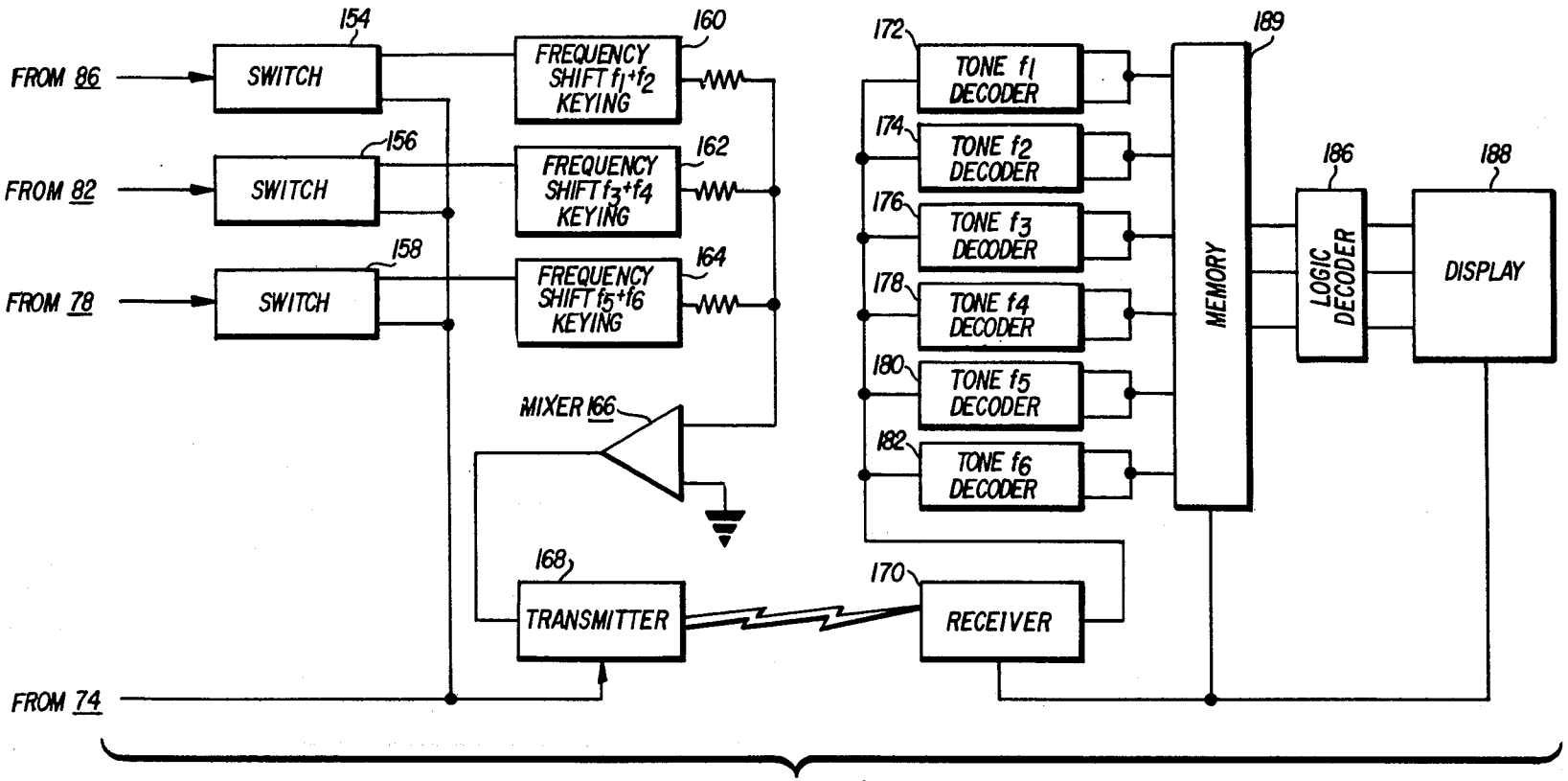
FIG. 13 shows a block diagram of a signal transmitting circuit and remote receiving and displaying circuit for use with the invention.

FIG. 13 shows a block diagram for a transmitter-receiver circuit adapted for use in the invention. The circuitry is shown for connection to the circuit of FIG. 3; however, those skilled in the art will understand that it may be readily adapted for use with the other embodiments of the invention. The outputs, if any, from tri-state switches 78, 82 and 86 are supplied to switches 154, 156 and 158, which are enabled by the output signal from OR circuit 74. The signals passing switches 154, 156 and 158 are supplied to frequency shift keying encoders 160, 162 and 164. Each encoder puts out a signal on a first, lower frequency for a logic "yes" input and on second higher frequency for a logic "no" input. Frequencies $f_1$ and $f_2$ for encoder 160, $f_3$ and $f_4$ for encoder 162 and $f_5$ and $f_6$ for encoder 164 are all different and are chosen so that none of them is a harmonic of another. The outputs of the encoders are then supplied to a mixer 166 which combines all the signals to form a tone or signal "burst". This mixed signal passes to a conventional transmitter 168 which has been energized for transmission by the output signal from OR circuit 74. A signal is then transmitted to the receiver portion of this embodiment.

Receiver 170 detects the transmitted signal and puts out a control pulse for the memory and display circuitry, to be discussed subsequently. The signal is then amplified as required and supplied in parallel to frequency shift keying decoders 172 for $f_1$, 174 for $f_2$, 176 for $f_3$, 178 for $f_4$, 180 for $f_5$ and 182 for $f_6$. If decoder 172, 176 or 180 detects its frequency, a logic "yes" output signal will be produced; whereas these decoders will produce a logic "no" output when their frequencies are not present. Decoders 174, 178 and 182 function identically. These outputs are supplied to a memory circuit 184, which has been activated or loaded by a signal from receiver 170. Memory circuit 184 must have sufficient storage capacity to retain decoded signals indicative of the location of ball contact for all the balls hit in a typical game. From memory 184, the information is supplied to a decoder 186 which converts the stored digital information to a form useful for display on display unit 188. For example, a seven segment alphanumerical display can be used which would indicate the number of ball contacts in a particular zone on the racquet. Or, the display could be made in the corner area of a conventional television tube to indicate the location on the racquet at which the players are striking the ball during play. Other adaptations such as use in commercial broadcasts of professional tennis to give the sportscaster and fan a rapid indication of how the ball is being played are also within the scope of the invention.

FIG. 14 shows a schematic diagram of another embodiment of the invention in which light from a source is reflected from the ball to a detector which is not aligned with the source. A plurality of sources $S_1$ to $S_8$ and Detectors $D_1$ to $D_8$ are arranged around the strung portion of the racquet and attached to it in either of the manner shown in FIGS. 2A and 2B. Sources $S_1$ and $S_5$ are arranged coaxially on either side of the long axis of the racquet; and detectors $D_1$ and $D_5$ are arranged symmetrically thereto. Thus, balls striking on or close to the long axis of the racquet will cause light to be reflected from a source back to its detector. To locate the point of ball contact along the axis, additional source-detector pairs are used. Thus, $S_2$-$D_2$ and $S_8$-$D_8$ monitor the low zone near handle 12; $S_3$-$D_3$ and $S_7$-$D_7$, the "sweet spot" or central zone; $S_4$-$D_4$ and $S_6$-$D_6$, the high zone furthest from handle 12. Of course, additional zones may be defined by adding more source-detector pairs, without departing from the invention. Because no detector is placed on line with a source, each detector responds only to ambient light and light reflected from its source. The use of more than one source-detector pair at each zone is considered preferrable to prevent false triggering of the device and to provide accurate monitoring of contact location; however, a single source-detector pair may be used where it is desirable simply to locate the contact at some point on a given axis.

Figure 15:
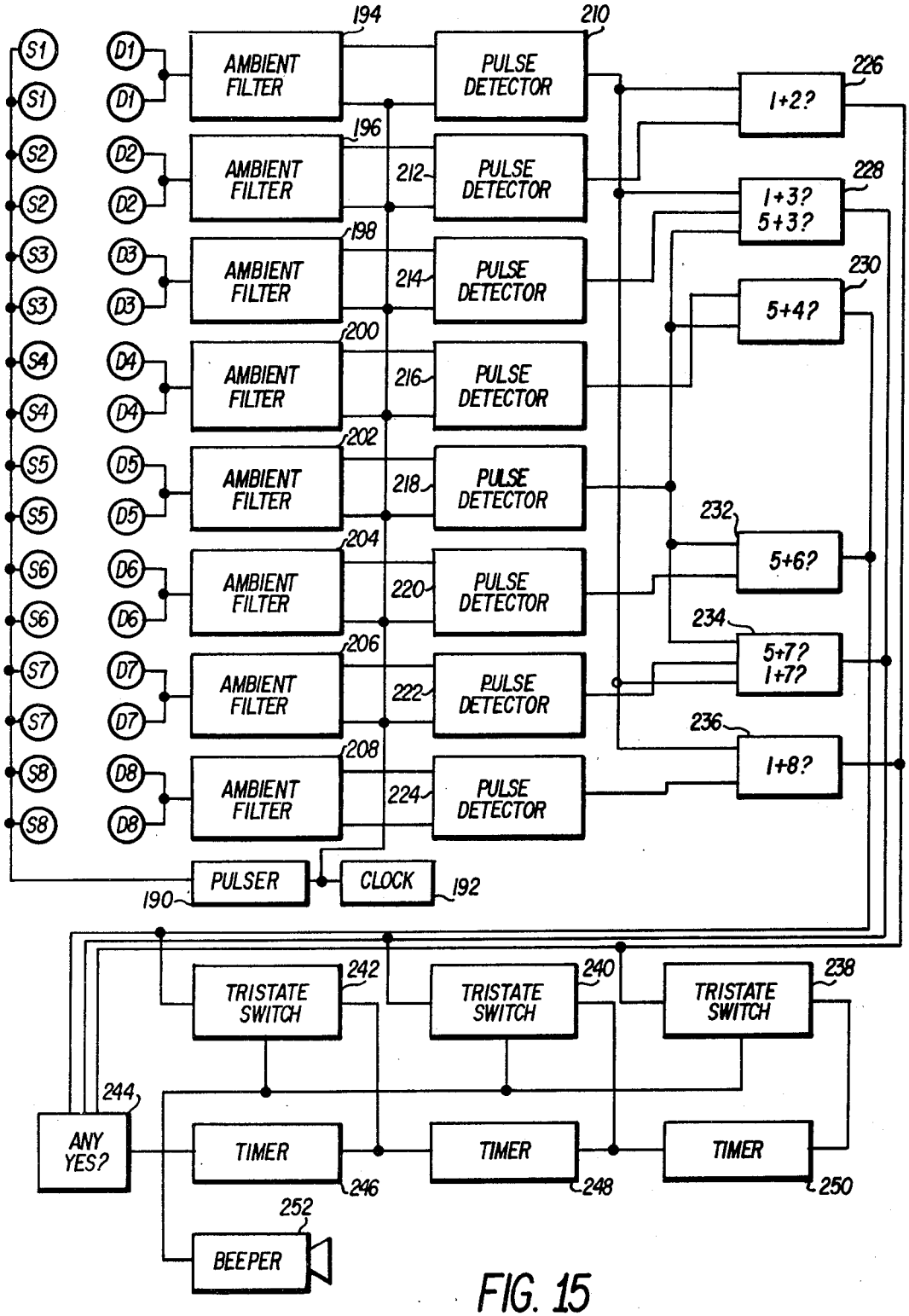
FIG. 15 shows a block diagram of a detection and indication circuit for use with the embodiment of FIG. 14.

FIG. 15 shows a block diagram of a detection-indication circuit for use with the embodiment of FIG. 14. As in the previously described embodiments, sources $S_1$-$S_n$ and detectors $D_1$-$D_n$ are located on both sides of the racquet; thus, two of each are shown in this diagram. Sources $S_1$ to $S_8$ are pulsed by pulser 190 which is driven by clock 192. The outputs from detectors $D_1$ to $D_8$ are supplied to ambient filters 194, 196, 198, 200, 202, 204, 206 and 208 which are activated by clock 192 to filter out the ambient light effects and produce an output only when a signal falling within predetermined limits is detected. These outputs are supplied to pulse detectors 210, 212, 214, 216, 218, 220, 222 and 224 which produce a logic "yes" when a pulse is detected and a logic "no" when no pulse is detected. The outputs of the pulse detector are supplied to AND gates 226, 228, 230, 232, 234 and 236, which produce a logic "yes" when the indicated combinations are detected and a logic "no" when the indicated combinations are not detected. The outputs of gates 226 and 236 are supplied to one terminal of a tri-state switch 238; of gates 228 and 248, to a tri-state switch 240; and of gates 230 and 232, to a tri-state switch 242. The outputs of all the AND gates are supplied to OR gate 244 the output signal of which starts a timer 246. When timer 246 produces its output, tri-state switch 242 is activated to produce a logic "yes" if the signal from either or both of gates 230 or 232 is a "yes"; and a logic "no" when neither of gates 230 or 232 produces a "yes" signal. The output from timer 246 also starts a timer 248 which, in turn, activates tri-state switch 240 and a timer 250. Timer 250 then activates tri-state switch 238 to complete the cycle. The sequential outputs of tri-state switches 238, 240 and 242 are thus supplied to beeper 252, which functions identically to beeper 88 as described with regard to FIG. 2. Reset is automatic for the next ball.

Figure 16:
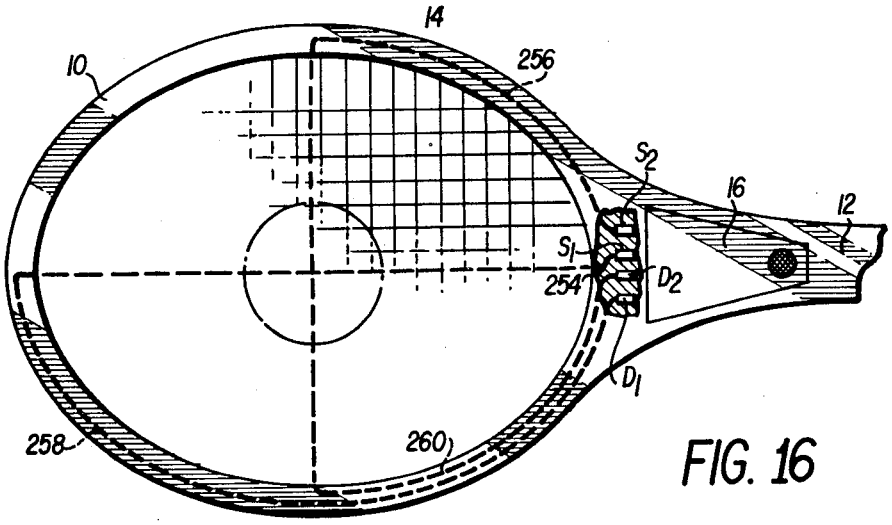
FIGS. 16 and 17 show the electro-fiber optical embodiment of the invention.

FIG. 16 shows a plan view of the strung portion of a racquet including the electro-fiber optical embodiment of the invention. In this embodiment, the light sources $S_1$, $S_2$. . . $S_n$ are located in the handle portion of the racquet and are actually incorporated into circuit 16. Light leaving source $S_1$ is transmitted via an optical fiber 254 to the inner surface of frame 10, where a light beam is projected across the long axis of the strung portion to the axially opposite end of the racquet. An optical fiber 256 transmits light from source $S_2$ to one side of frame 10, where a light beam is projected across the strung portion of the racquet to intersect the beam from source $S_1$ at approximately the middle of the strung portion. Of course, other intersection points may be used if desired. The beams from sources Shd 1 and $S_2$ are received by optical fibers 258 and 260 and transmitted thereby to detectors $D_1$ and $D_2$. Thus, the presence of a ball at the intersection of the light beams will block both light beams in a manner analogous to the embodiment shown in FIGS. 1 to 3. Circuit 16 functions identically to that shown in FIG. 3.

Figure 17:
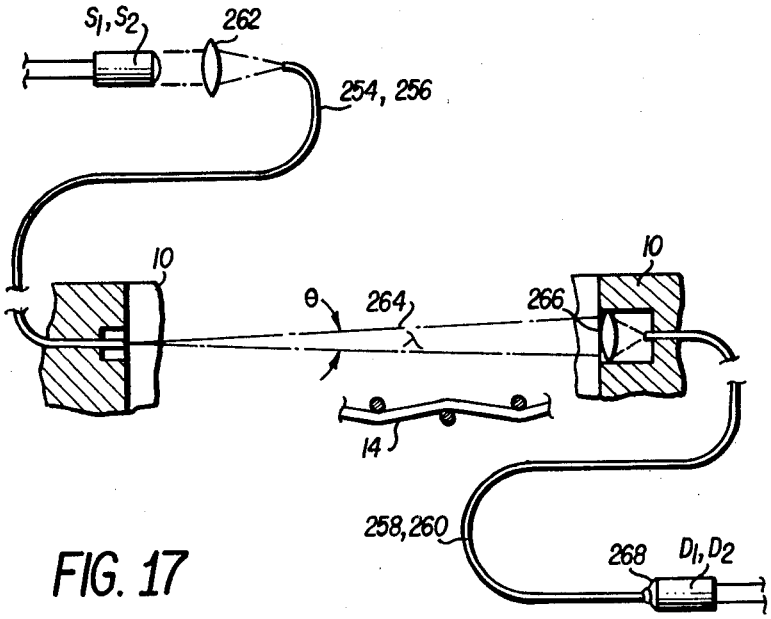

FIG. 17 shows a schematic representation of the light transmission path between sources $S_1$ and $S_2$ and detectors $D_1$ and $D_2$. Light leaving source $S_1$, $S_2$ is focussed onto the end of fiber 254, 256 by an optical device such as lens 262. Fibers 254, 256, 258, 260 are of plastic or glass construction and of about 0.020 to 0.050 inch diameter and are embedded in frame 10 as indicated in phantom in FIG. 16. At the other end of fiber 254,256 a light beam 264 is transmitted, having a small angle of divergence $\theta$. At the opposite side of frame 10, beam 264 is received by an optical device such as lens 266 which focuses the beam onto the end of fiber 258, 260. The light is then transmitted to the other end of fiber 258,260 which is attached to the input lenslet 268 of detector $D_1$, $D_2$ by means such as an epoxy cement. Lenses 262 and 266 are necessary to condense the received light sufficiently to ensure transmission of an adequate signal.

While the invention is disclosed with source-detector pairs in which each part of the pair is located on one side of strings 14, it is also within the scope of the invention to locate the source on one side of strings 14 and the detector on the opposite side, with the light transmission path passing through the openings between strings 14. In this case, a higher intensity or larger diameter beam is used to overcome any interference by the strings; however, the invention functions identically to the electro-optical embodiments previously discussed.

While the invention has been disclosed for application to a tennis racquet, those skilled in the art will understand that the principles thereof are applicable to many other fields of sport where the point of contact of a ball or similar game element with a bat, racquet or other athletic instrument is important to ensure that the ball is propelled away in the desired direction, with optimum velocity and minimum shock transmission to the player. Particularly in such fields of sport, maintaining eye contact with the ball or playing element is of utmost importance. "Learning to see the ball consistently is the most important art in tennis at all levels of play". *Tennis Gazette,* Volume 1, No. 4, November-December 1975, "Oh Say Can You SEE" by W. Timothy Gallway, pp. 10–11. Use of a tennis racquet according to this invention will enable the player to know immediately whether eye contact has been maintained and a proper hit made.

Having described our invention in sufficient detail to enable those skilled in the art to make and use it, we claim:

1. In combination, an implement adapted to be entirely supported by hand and movable to strike a movable game element to impart motion thereto, said implement comprising at least one area in which contact with the game element is intended to be made;

electrically conductive coating means applied to a portion of said at least one area for defining at least one conductor extending to at least one preselected location within said at least one area;

an electrical circuit including said at least one conductor;

means for detecting a change in the electrical properties of said circuit due to contact by the game element at said at least one preselected location; and means responsive to said detecting means for providing an indication of the presence of the game element at said at least one preselected location.

2. The combination of claim 1, wherein said implement is a racquet.

3. The combination of claim 2, wherein said racquet comprises a strung portion including said at least one area, said coating means being applied to at least one string in said strung portion.

4. The combination of claim 3, wherein said coating means defines spaced contacts on said at least one string which can be bridged by the game element.

5. The combination of claim 4, wherein said detecting means detects a change in electrical resistance between said spaced contacts.

6. The combination of claim 3, wherein said coating means is impregnated into said at least one string.

7. The combination of claim 2, wherein said detecting means detects said game element on either side of said racquet.

8. The combination of claim 1, wherein said detecting means detects repeated contacts by said game element without requiring intervention by a player using said implement.

9. The combination of claim 1, wherein said means for providing an indication comprises an audible signal generator.

10. The combination of claim 1, wherein said detecting means detects a change in electrical resistance.

11. In combination, a racquet for striking a movable game element to impart motion thereto, said recquet comprising at least one area in which contact with the game element is intended to be made;

electrically conductive coating means applied to a portion of said at least one area for defining at least one conductor extending to at least one preselected location within said at least one area;

an electrical circuit including said at least one conductor;

means for detecting a change in the electrical properties of said circuit due to contact by the game element at said at least one preselected location; and means responsive to said detecting means for providing an indication of the presence of the game element at said at least one preselected location.

12. The combination of claim 11, wherein said racquet comprises a strung portion including said at least one area, said coating means being applied to at least one string in said strung portion.

13. The combination of claim 12, wherein said coating means is impregnated into said at least one string.

14. The combination of claim 12, wherein said coating means defines spaced contacts on said at least one string which can be bridged by the game element.

15. The combination of claim 14, wherein said detecting means detects a change in electrical resistance between said spaced contacts.

16. The combination of claim 11, wherein said detecting means detects repeated contacts by said game element without requiring intervention by a player using said implement.

17. The combination of claim 11, wherein said detecting means detects said game element on either side of said racquet.

18. The combination of claim 11, wherein said means for providing an indication comprises an audible signal generator.

19. The combination of claim 11, wherein said detecting means detects a change in electrical resistance.

* * * * *